US006308037B1

(12) United States Patent
Yamashita

(10) Patent No.: US 6,308,037 B1
(45) Date of Patent: Oct. 23, 2001

(54) METHOD AND APPARATUS FOR FORMING AN ELECTROSTATIC IMAGE

(75) Inventor: Toshimi Yamashita, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/502,771

(22) Filed: Apr. 27, 2000

(51) Int. Cl.[7] ..... G03G 15/09
(52) U.S. Cl. ..... 399/272
(58) Field of Search ..... 399/272, 267, 399/274, 275, 281, 282

(56) References Cited

U.S. PATENT DOCUMENTS 4,947,211 * 8/1990 Ono et al. ..... 355/265
5,461,465 * 10/1995 Sunaga et al. ..... 355/245
5,809,386 * 9/1998 Iwata ..... 399/281
5,943,537 * 8/1999 Ahn ..... 399/254
5,995,791 * 11/1999 Kawasaki ..... 399/281

FOREIGN PATENT DOCUMENTS 7-40156 5/1995 (JP) .
7-43554 5/1995 (JP) .

* cited by examiner

*Primary Examiner*—William J. Royer
(74) *Attorney, Agent, or Firm*—Foley & Lardner

(57) ABSTRACT

An image forming apparatus according to the present invention has a developing roller which supplies a developer to a developing target, a housing which contains the developer, a developer agitating member which is rotated about a rotation center defined at a predetermined position in the housing and below a rotation center of the developing roller in the vertical direction, a table-like area which is defined at a predetermined position in the housing and temporally supports the developer material moved between the developing roller and the developer agitating member, and a developing apparatus included of a projective member for controlling the amount of the developer which is supplied onto the outer circumference of the developing roller.

13 Claims, 3 Drawing Sheets

METHOD AND APPARATUS FOR FORMING AN ELECTROSTATIC IMAGE

BACKGROUND OF THE INVENTION

The present invention relates to a developing apparatus which develops an electrostatic image by feeding a toner as a visualizing material in an image forming apparatus represented by, for example, a copying machine of electrophotographic system or a laser beam printer.

Known developing apparatuses which are incorporated in image forming apparatuses using electrophotographic process are of a two-component system which uses a carrier and a toner for a developer, and a one-component system which uses only a toner for a developer. In addition, a proposal has been recently made for a developing apparatus which is of the one-component system and also uses a small amount of magnetic carrier.

Developing apparatuses which are of the one-component system and also use a small amount of magnetic carrier is known from Japanese Patent Application KOKOKU Publication No. 7-40156 and Japanese Patent Application KOKOKU Publication No. 7-43554. These publications disclose an example in which a carrier container area for preventing a toner, which has fallen from a developing sleeve, from being mixed into a toner holding section is positioned below a developing sleeve.

Japanese Patent Appplication KOKAI Publication No. 9-6106 will be cited as an example in which an area for holding a developer is provided under the developing sleeve. According to this publication, a developer is fed by a rotation arm rotated about a rotation center which is positioned lower than the rotation center of the developing sleeve, and a part of a developing housing which holds the developer such that the developer can be fed to the developing sleeve is formed under the developing sleeve.

Each of the developing apparatuses described above has a common feature that the toner is magnetized and a toner layer is formed on the surface of the developing sleeve by a magnetic roller in which N and S poles are provided alternately.

However, in the developing apparatus disclosed in each publication, there is a limitation to the layout of the developing sleeve and the magnetic roller for feeding the toner onto the developing sleeve with predetermined thickness, due to influences from the layout of magnetic poles and the like. Therefore, a problem arises in that all the toner contained in the toner container section of the developing apparatus can not be fed to the developing sleeve.

Hence, in the developing apparatus disclosed in each publication, a toner holding section which is a part of a container area and a developing housing is provided between the magnetic roller and the toner container section.

However, every of the developing apparatuses disclosed in the above described publications has a problem that a large amount of toner remains in the toner holding section in the developing apparatus and a next charge of toner is requested regardless of the remaining toner.

BRIEF SUMMARY OF THE INVENTION

An object of the present invention is to provide an image forming apparatus which is capable of maintaining a stable image density for a long time period without causing any unevenness of density due to short toner feed.

Another object of the present invention is to provide a developing apparatus which is capable of reducing the amount of toner which may remain in a toner hopper.

A further another object of the present invention is to provide a developing apparatus which is capable of feeding toner stably toward a developing roller.

The present invention has been made on the basis of the problem described above and provides an image forming apparatus comprising an image forming section for forming a latent image on an image carrier, and a developing apparatus for supplying a visualizing agent to the latent image formed on the image carrier, thereby to develop the latent image, said developing apparatus including: a housing for holding a toner fed to a latent image formed on a image carrier; a developing roller provided to be rotatable about a rotation center positioned below a rotation shaft of the image carrier in a vertical direction; a supporting member as a part of the housing, for positioning the toner close to the developing roller; and an agitation member provided to be rotatable in the housing and having sheet-like member having a free length which is defined to be longer than a distance between a rotation center of the sheet-like member and a wall surface of the housing, for feeding the toner in the housing to the supporting member and for agitating the toner in the housing, as the agitation member is rotated along an inner wall of the housing.

Also, the present invention provides a method for forming an image with use of an image forming apparatus, comprising steps of: forming a latent image on an image carrier; and feeding a visualizing agent to the image formed on the image carrier, thereby to develop the image, wherein the step of feeding the visualizing agent includes a housing for holding a toner fed to a latent image formed on a image carrier, a developing roller provided to be rotatable about a rotation center positioned below a rotation shaft of the image carrier in a vertical direction, a supporting member as a part of the housing, for positioning the toner close to the developing roller, and an agitation member provided to be rotatable in the housing and having sheet-like member having a free length which is defined to be longer than a distance between a rotation center of the sheet-like member and a wall surface of the housing, for feeding the toner in the housing to the supporting member and for agitating the toner in the housing, as the agitation member is rotated along an inner wall of the housing.

Further, the present invention provides an image forming apparatus comprising: a developing apparatus including a photosensitive member on which a latent image corresponding to image information to be outputted is formed, for supplying selectively a toner to the latent image formed on the photosensitive member, thereby to develop the latent image, said photosensitive member including a developing magnet internally provided with N and S poles arranged alternately, a sleeve formed to be rotatable on an outer circumference of the developing magnet, for supplying an image carrier with a toner to be supplied onto the latent image formed on the image carrier, a toner hopper as a part of the housing, provided below a rotation center of the sleeve in a vertical direction at a predetermined distance therefrom, and having a table for holding temporarily the toner which should be supplied to the sleeve, thereby to contain the toner, a developer agitating member formed to be rotatable in the toner hopper, as an elastic member having a longer free length than a inner diameter of the toner hopper, for feeding the toner in the toner hopper toward the sleeve and for agitating the toner, as the developer agitating member is rotated later in comparison with vicinity of a rotation center when the developing agitating member is rotated in the toner hopper, and a supporting member defined at a predetermined position in the housing, for temporally supporting the developer which is moved by the developer agitating member; and a transfer device for transferring a toner image formed on the photosensitive member by the developing apparatus, to a transfer target object.

DETAILED DESCRIPTION OF THE INVENTION

A developing apparatus according to an embodiment of the present invention will now be explained below with reference to the drawings.

Figure 1:
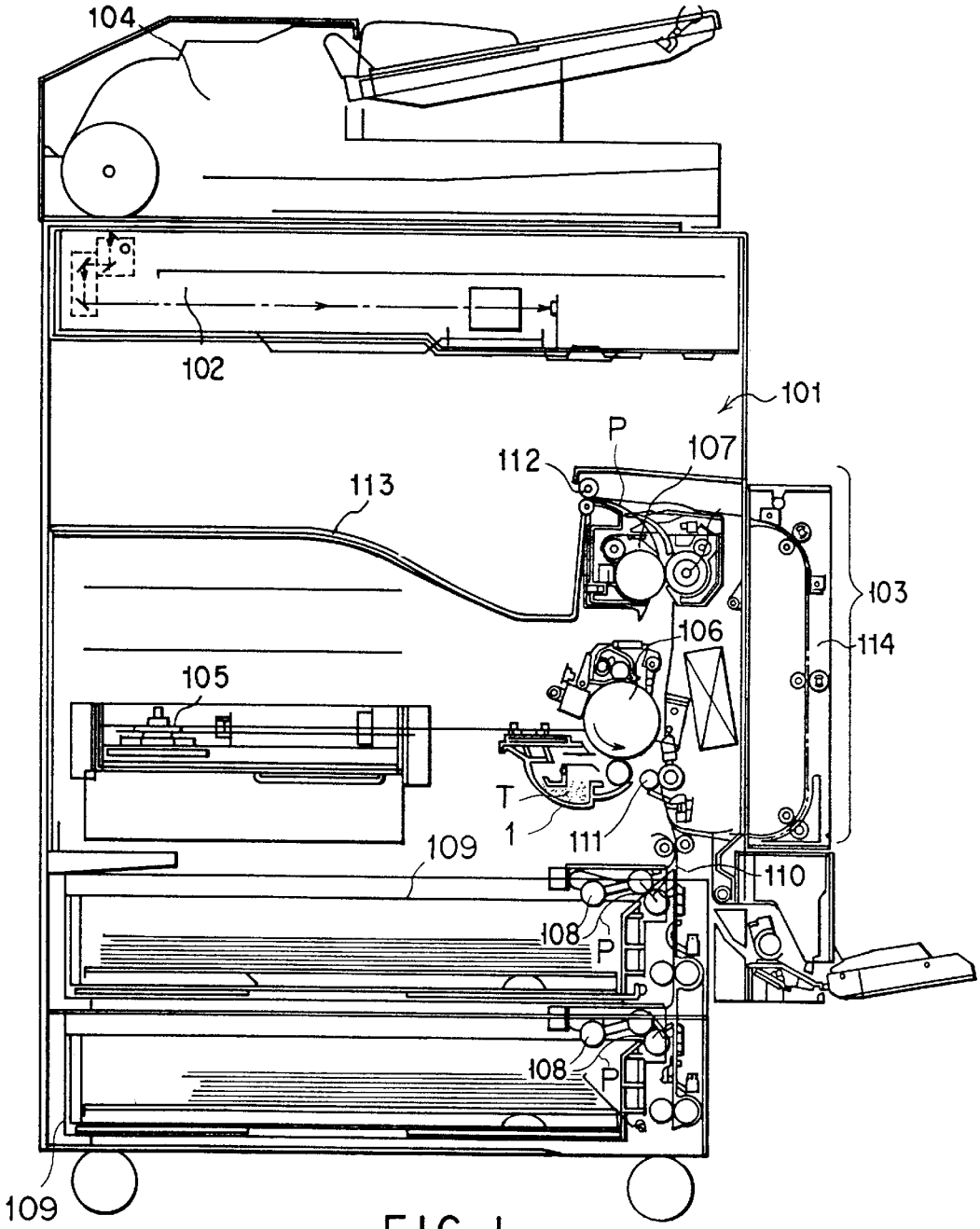
FIG. 1 is a schematic view illustrating the entire structure of an image forming apparatus to which an embodiment of the present invention applied.

FIG. 1 is a schematic diagram illustrating a digital copying apparatus 101 as an example of an image forming apparatus.

As shown in FIG. 1, the digital copying apparatus 101 is comprised of a scanner 102 which generates an image signal by reading image information as contrast of light from a book or an original document including an arbitrary number of sheets, which is a target to be copied, and an image forming section 103 which forms an image corresponding to an image signal supplied from the scanner 102 or the outside. The scanner 102 is integrally provided with an automatic document feeder (ADF) 104 which sequentially exchanges sheet-like objects to be copied, linked with the operation of reading images by the scanner 102, in case where the copy target are sheet-like objects.

The image forming section 103 comprises an exposure device 105 which irradiates a laser beam corresponding to image information supplied from the scanner 102 or an external device, a photosensitive drum 106 which holds an image corresponding to the laser beam from the exposure device, a developing apparatus 1 which feeds a developer to the image formed on the photosensitive drum 106 to develop the image, and a fixing device 107 which heats and melts a Ad developer image that has been transferred to a transfer material supplied by a sheet conveyer section described later, thereby to fix the developer image to the transfer material.

When image information is supplied from the scanner 102 or an external device, a laser beam subjected to intensity modulation depending on the image information is irradiated from the exposure device 105 to the photosensitive drum 106 which has previously been electrified to a predetermined electric potential, said laser beam being.

In this manner, an electrostatic latent image corresponding to the image to be copied is formed on the photosensitive drum 106.

The electrostatic latent image formed on the photosensitive drum 106 is developed as toner T is fed selectively by the developing apparatus 1 and is transferred to a paper P as a transfer material supplied from a cassette described below, by an electric field supplied from a transfer device which will not be specifically described.

The toner T transferred to the paper P is carried to the fixing device 107 and is melted by the fixing device 107, so the toner is fixed to the paper P.

Papers P are picked up sheet by sheet from a paper cassette 109 provided under the photosensitive drum 106 by a pick-up roller 108, and pass through a conveyance path 110 toward the photosensitive drum 106. The papers are then conveyed to an aligning roller 111 for aligning every paper P with the position of a toner image (developer image) formed on the photosensitive drum 106, and are fed, at a predetermined timing, to a transfer position where the photosensitive drum 106 and the transfer device face each other.

A paper P onto which an image formed with the toner T by the fixing device 107 has been fixed is delivered to a delivery space (delivery tray) 113 defined between the scanner 102 and the cassette 109, by a paper delivery roller 112, said delivery space provided. If necessary, a double-side sheet feeder 114 for inverting the paper P, to one surface of which an image has already been fixed, may be provided between the scanner 102 and the cassette 109.

Next, the developing apparatus 1 will be explained in details.

Figure 2:
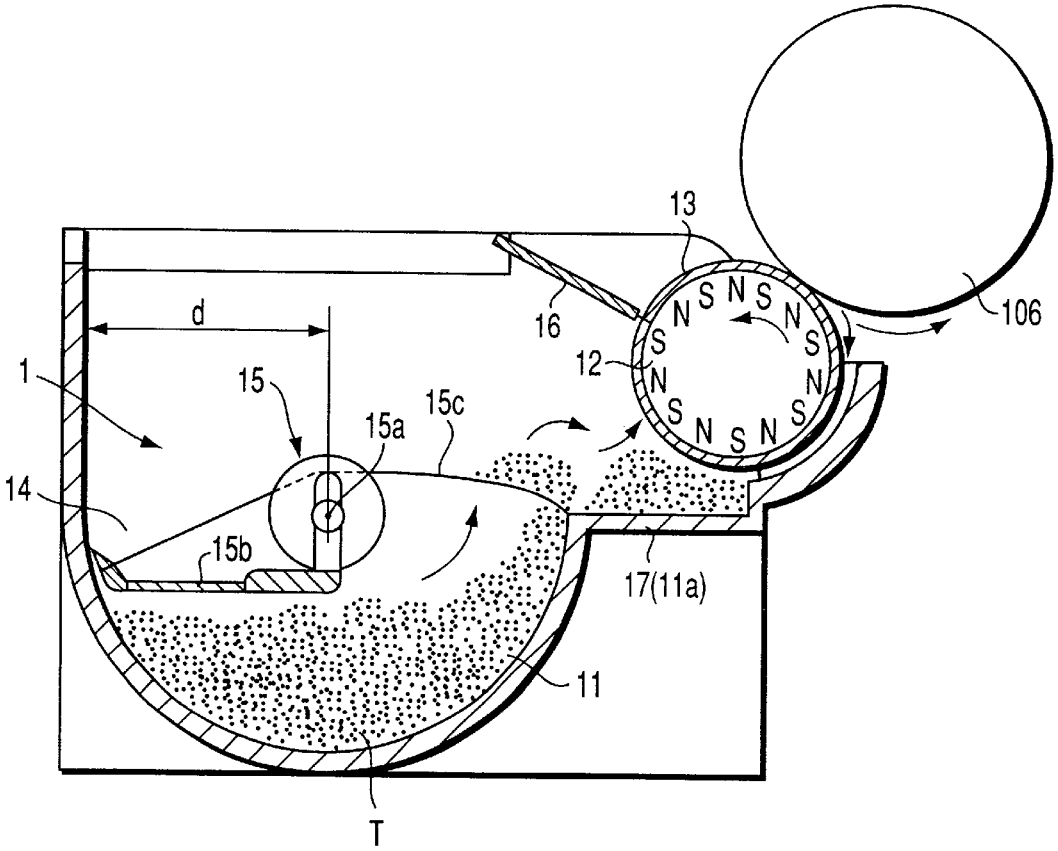
FIG. 2 is a partially cut-away enlarged schematic view showing a developing apparatus incorporated in the image forming apparatus shown in FIG. 1.

FIG. 2 is a schematic sectional view illustrating an embodiment of a fixing device incorporated in the digital copying apparatus shown in FIG. 1.

As shown in FIG. 2, the developing apparatus 1 has a housing 11.

When starting operation, the housing 11 is supplied with a start material containing a carrier and a toner which have been previously mixed. When charging toner thereafter, only toner is supplemented. Note that the toner used herein will be a magnetic toner having an average grain size of 11 $\mu$m and magnetized by mixing a magnetic material therein and the carrier used herein is a carrier (ferrite-based or iron-based carrier) having an average grain size of 65 $\mu$m.

At a predetermined position on the housing 11, there are provided integrally a rotatable magnet roller 12 and a developing sleeve 13 which is formed to be rotatable on the outer circumference of the magnetic roller 12 independently from this roller 12. The developing apparatus 1 is positioned such that 0.35 mm is substantially the distance between the outer circumferences of the development sleeve 13 and the photosensitive drum 106 at a position where both the outer circumferences are closest to each other. The development sleeve 13 has a diameter of 20 mm and is rotated at a moving speed of 254 mm/s in the same direction as the outer circumferential surface of the magnetic roller 12, at a position where the developing sleeve 13 faces the outer circumferential surface of the drum 106 (although their rotation directions are opposite to each other about their rotation axes).

In the magnet roller 12, N poles and S poles which are, for example, total 12 poles are arranged alternately at substantially uniform intervals in the circumferential direction when viewed from the direction perpendicular to the center axis. The magnetic force of each magnetic pole of the magnetic rollers 12 is substantially 700 gauss where the force is measured at the surface of the developing sleeve 13. The magnetic roller is rotated, for example, at the speed of 2000 rpm in a direction opposite to that of the forming sleeve 13.

Below the axis of the developing sleeve 13 in the vertical direction, there are provided a toner hopper 14 as a part of the housing 11, which contains toner consumed by image formation, and an agitator 15 which agitates toner in the toner hopper 14 and carries the toner toward the developing sleeve 13. The rotation center of the agitator 15 is positioned below the rotation center of the developing sleeve 13 in the vertical direction. Also, the agitator 15 is rotated in the same direction as the magnet roller 12 in this example.

A blade 16 for adjusting the thickness of a toner layer formed of toner sticking to the outer circumferential surface of the developing sleeve by the agitator 14 of the toner hopper 14 is provided at a predetermined position around the developing sleeve 13 and in the upstream side in the direction in which the developing sleeve 13 is rotated, with respect to the position where the sleeve faces the photosensitive drum 16 of the image forming section 103 explained previously with reference to FIG. 1. This blade 16 is provided such that the distance between the top end of this blade 16 and the outer circumferential surface of the developing sleeve 13 is substantially 0.25 mm when both the blade and sleeve are closest to each other, and that the blade 16 is at such a position that does not interfere with the circle defined by rotation of the agitator 15.

The portion which is a part of the housing 11 and connects an area where the developing sleeve 13 is positioned with the toner hopper 14 is used for increasing the amount of toner sticking to the developing sleeve 13 when the toner fed by the agitator 15 is let stick to the circumferential surface of the developing sleeve 13, below the developing sleeve 13. That is, of the housing 11, the area positioned below the developing sleeve 13 and connecting a part covering the developing sleeve 13 with the toner hopper 14, i.e., a stepping portion 11*a* of the housing functions as a toner table 17 which holds temporally the toner carried by the agitator 15.

The height of the toner table 17 is defined such that this table is situated lower than the center of the rotation axis 15*a* of the agitator 15 positioned in the toner hopper 14 in the vertical direction. Also, the horizontal length of the toner table 17 is defined to be equal to or shorter than the diameter of the developing sleeve 13.

The agitator 15 comprises a mold section 15*a* molded to be integral to the rotation shaft 15*a* of the agitator 15, and a film section 15*c* provided separately on the rotation shaft 15. Each of the molding section 15*b* and the film section 15*c* is provided with a plurality of openings to withstand a pressure from the toner in the toner hopper 14 and makes it possible to carry predetermined toner.

Figure 3:
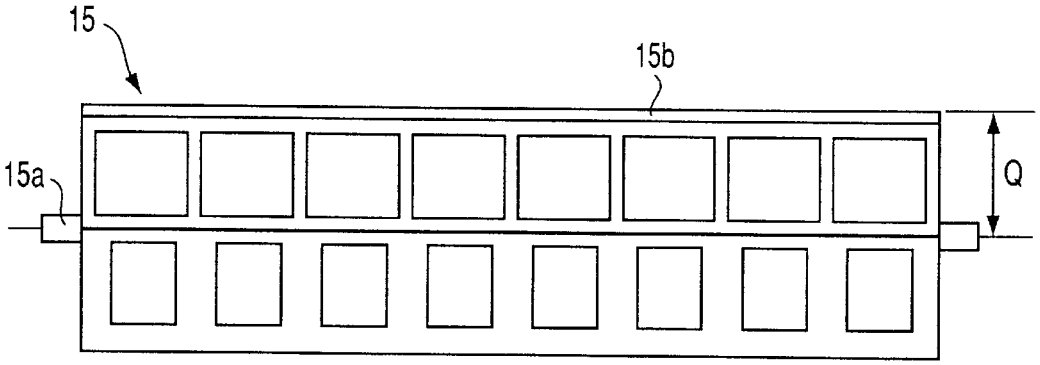
FIG. 3 is a schematic view illustrating the structure of a agitation mechanism incorporated in a toner storage section of the developing apparatus shown in FIG. 2.

Since the molding section 15*b* is molded simultaneously together with the rotation shaft 15*a* made of resin, the molding section 15*b* can carry toner to the developing sleeve 13 and the toner table 17 before the sleeve while relaxing the toner (which coheres) as the rotation shaft 15*a* is rotated, even when the toner in the toner hopper 14 coheres. The length Q of the molding section 15*b* is, as shown in FIGS. 2 and 3, is shorter by 0.5 to 0.3 mm than an inner diameter d of the toner hopper 14.

Meanwhile, the film section 15*c* is a thin film, for example, made of polyester which is separate from the rotation shaft 15*a* and the molding 15*b*. The film section 15*b* can relax the toner in the toner hopper 14 and carry a portion of toner, which is close to the inner wall of the toner hopper 14 and cannot be carried by the molding section 15*b*, to the forming sleeve 13. The length (free length) of the film section 15*c* is defined to be longer by 0.5 to 0.3 mm than the inner diameter d of the toner hopper 14, and the film section 15 is rotated in contact with the inner surface of the toner hopper 14 as the rotation shaft 15*a* is rotated. In this manner, almost all amount of toner in the toner hopper 14 can be carried to the forming sleeve 13. The length of the film section 15*c* is set within an appropriate range of length as described later with FIG. 4.

The film section 15*c* is projected into the toner hopper 14 from a position offset from the center of the rotation shaft 15*a* by a predetermined distance. Therefore, toner can be fed stably to the above-described toner table 17. The offset amount by which the film section 15*c* is offset from the rotation shaft 15*a* is defined within a position range in which the film section 15*c* is positioned above the toner table 17 in the vertical direction and is lower than or substantially equal to the lowermost portion of the outer circumferential surface of the developing sleeve 13, where the offset amount is obtained when an open end of the film section extends horizontally.

Next, the agitator 15 and the toner table 17 explained with FIGS. 1, 2 and 3 will now be explained in more details.

Figure 4:
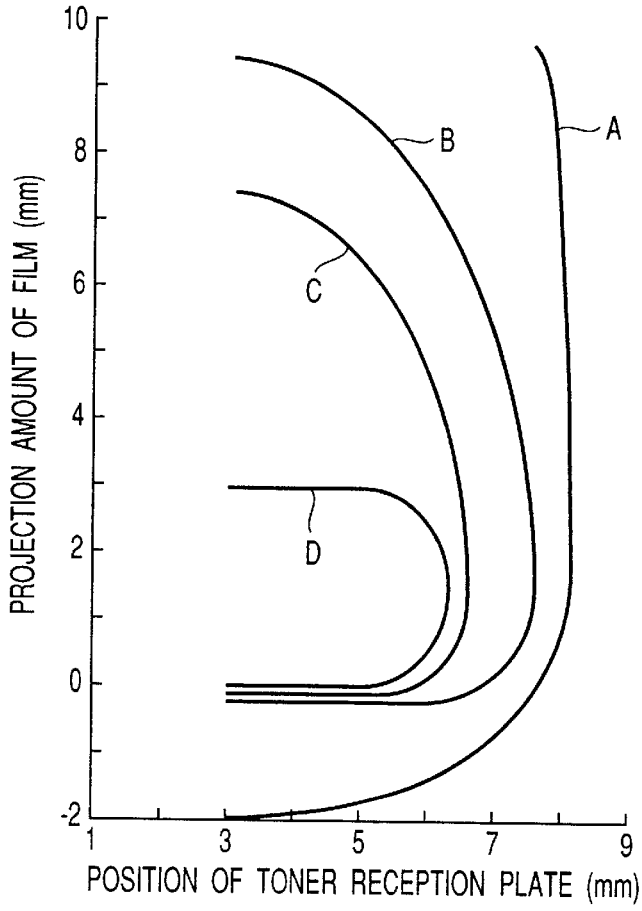
FIG. 4 is a graph explaining a state where the toner remaining in the toner storage section of the developing apparatus in FIG. 2 is reduced by using the agitation mechanism shown in FIG. 3.

FIG. 4 is a graph explaining a relationship among the projection amount by which the open end projects from the toner hopper 14 (the difference in case where the free length of the film section 15*c* is longer (shorter) than the radius d of the toner hopper 14), the shortest distance between the toner table 17 and the outer circumference of the developing sleeve 13 in the vertical direction, and the amount of toner remaining in the toner hopper 14 (residual amount of toner), where the free length of the film section 15*c* of the agitator 15 is measured when the open end extends horizontally.

In FIG. 4, the lateral axis expresses the distance between the toner table 17 and the developing sleeve 13 (in mm, no data for 3 mm or less) and the longitudinal axis expresses the amount by which the open end of the film section 15*c* projects if the free length of the film portion 15*c* is longer than the radius d of the toner hopper 14 in the opening edge of the film portion 15*c* (or the size by which the free length is shorter than the radius d in case of [−]). Curves A, B, C and D respectively shows the cases of residual where the residual toner amounts in the toner hopper 14 are substantially 120 g, 80 g, 70 g and 60 g.

From FIG. 4, it is found that about 120 g or more of toner remains in the toner hopper 14 regardless of the size of difference between the toner table 17 and the outer surface of the developing sleeve 13, if the projection amount of the film section 15*c* is −2 mm (i.e., the film section 15*c* does not reach the inner wall of the toner hopper 14).

Likewise, it is found that about 70 g or more of toner remains in the toner hopper 14 when the distance between the toner table 17 and the outer circumference of the developing sleeve 13 exceeds 5 mm if the projection amount of the film section 15*c* is substantially 0 mm (i.e., the film section 15*c* contacts the inner wall of the toner hopper 14). Also, it is found that about 70 g or more remains in the toner hopper 14 when the distance between the toner table 17 and the outer circumference of the developing sleeve 13 exceeds 6 mm if the projection amount of the film section 15*c* is 4.

Meanwhile, from the range indicated by the curve D, it is found that the toner amount remaining in the toner hopper 14 is decreased to about 60 g if the distance between the toner table 17 and the outer circumference of the forming sleeve 13 is smaller than about 6 mm (up to 3 mm) and the projection amount of the film section 15*c* is about 0 to 3 mm.

As described above, most of toner in the toner hopper 14 can be fed toward the developing sleeve 13 by connecting the area containing the developing sleeve 13 of the housing 11 of the developing apparatus with the toner hopper 14 as a part of the housing 11 through the toner table 17, by positioning the rotation center of the agitator 15, which is provided in the toner hopper, above the toner table 17 in the vertical direction, and by making the open end of the film section 15*c* of the agitator 15 longer by about 3 mm at most than the radius of the toner hopper 14. In addition, even when toner coheres, cohesion of toner can be relaxed so that the toner can be fed uniformly toward the developing sleeve 13. That is, since the length of the film section 15*c* is defined to be longer by 0 to 3 mm than the distance (radius of the toner hopper 14) between the rotation center of the agitator 15 and the inner wall of the toner hopper 14, the portion by which the film section 15*c* is longer than the distance between the inner wall of the toner hopper 14 and the rotation center of the agitator 15 is rotated later compared with the rotation of the rotation center of the agitator 15 while the portion is kept in contact with the inner wall of the toner hopper 14. As a result, it is possible to reduce the residual amount of toner which remains in the toner hopper 14. It is also found that a larger amount of toner can be fed to the toner table, compared with the case where the horizontal height when the film section 15*c* of the agitator 15 is positioned horizontally and the case where the toner table 17 is positioned above the horizontal height of the film section 15*c* in the vertical direction, since the toner table 17 is positioned below the horizontal height where the film section 15*c* of the agitator 15 is positioned horizontally, in the vertical direction.

Figure 5:
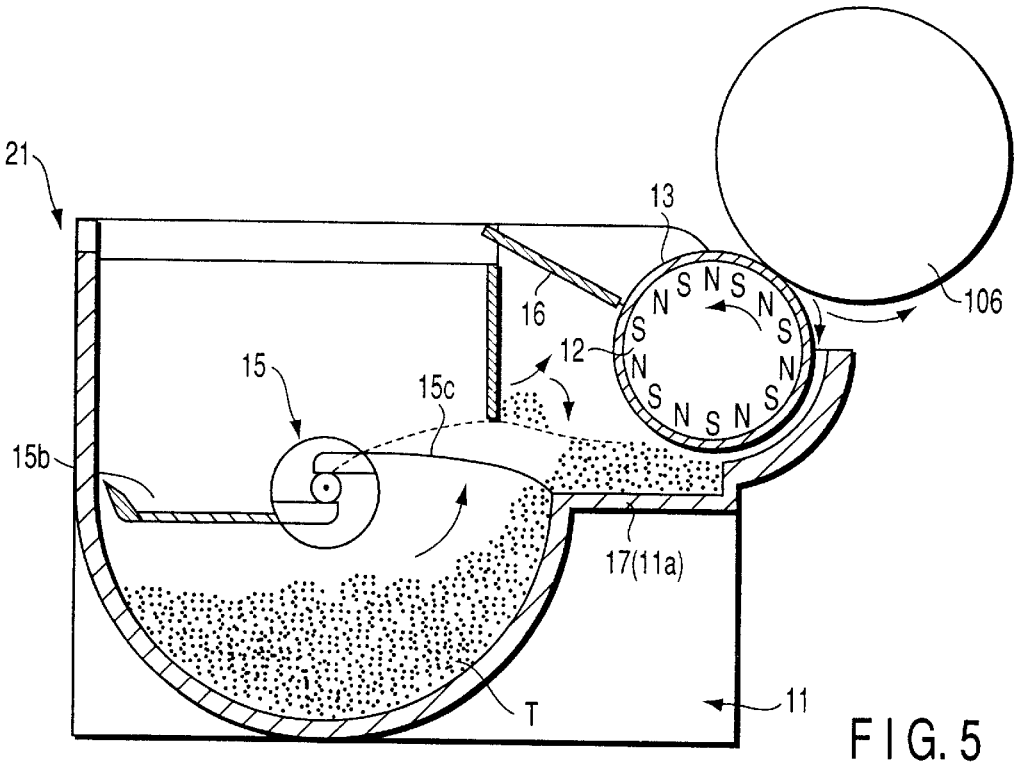
FIG. 5 is a schematic view for explaining another embodiment of the developing apparatus shown in FIG. 2.

FIG. 5 is a schematic view illustrating another embodiment of the developing apparatus shown in FIG. 2.

The developing apparatus 21 has a structure similar to the developing apparatus 1 shown in FIG. 2 and comprises a housing 11, a magnetic roller 12, a developing sleeve 13, a toner hopper 14 integral to the housing 11, an agitator 15, a blade 16, a toner table 17, and a toner scraper plate 22 provided between the blade 16 and the agitator 15.

The toner scraper plate 22 serves to scrape off toner, which is carried as the agitator 15 rotates, toward the toner table 17, and the top end portion of the toner scraper plate is structured so as to reach an area having a diameter which is larger than that of a circle defined by the rotation of the mold section 15*b* of the agitator 15 and is smaller than that of a circle which is defined by the rotation of the film section 15*c*.

Since the toner scraper plate 22 drops the other portion of toner which remains in the film section 15*c*than the portion of toner which has been fed by the film section 15*c* in accordance with the rotation of the agitator 15 and has fallen toward the toner table 17, it is possible to feed toner of an amount equal to or more than the amount of toner which the developing apparatus 1 shown in FIG. 2 or can feed.

As described above, the developing apparatus 1 according to the present invention comprises a toner table (a table-like section) and can efficiently feed toner in the housing to the vicinity of a developing roller, so a density difference is difficult to occur.

As a result, it is possible to attain an image forming apparatus capable of creating a stable image density for a long time.

Also, in the developing apparatus, since the agitating member which feeds toner in the housing toward a developing roller comprises a film-like member which is elastic and has a larger free length than the inner diameter of the housing, it is possible to reduce the residual amount of toner which remains in the housing.

As a result, there is provided an image forming apparatus capable of outputting an image onto a planned number of sheets.

What is claimed is:

1. An image forming apparatus comprising an image forming section for forming a latent image on an image carrier, and a developing apparatus for supplying a visualizing agent to the latent image formed on the image carrier, thereby to develop the latent image, said developing apparatus including:

a housing for holding a toner fed to the latent image formed on the image carrier;

a developing roller provided to be rotatable about a rotation center positioned below a rotation shaft of the image carrier in a vertical direction;

a supporting member as a part of the housing for positioning the toner close to the developing roller; and an agitation member provided to be a rotatable in the housing and having sheet-like member having a free length which is defined to be longer than a distance between a rotation center of the sheet-like member and a wall surface of the housing, for feeding the toner in the housing to the supporting member for agitating the toner in the housing, as the agitation member is rotated along an inner wall of the housing, wherein the supporting member is positioned lower in a vertical direction, compared with a rotation center of the agitation member.

2. An image forming apparatus according to claim 1, wherein the toner contains a magnetic toner.

3. An image forming apparatus according to claim 1, wherein the agitation member has a rotation center positioned below the rotation center of the developing roller in a vertical direction.

4. An image forming apparatus according to claim 1, wherein the agitation member includes a second agitation member defined to be shorter than the distance between the rotation center of the sheet-like member and the inner wall of the housing.

5. An image forming apparatus according to claim 1, wherein the sheet-like member of the agitation member is positioned above the supporting member in a vertical direction where the sheet-like member is situated horizontal.

6. An image forming apparatus according to claim 1, wherein a blade member for limiting thickness of the visualizing agent supplied to an outer circumference of the developing roller is included at a predetermined position close to the developing roller of the developing apparatus.

7. A method for forming an image with use of an image forming apparatus, comprising the steps of:

forming a latent image on an image carrier; and feeding a visualizing agent to the latent image formed on the image carrier, thereby to develop the latent image, wherein the step of feeding the visualizing agent includes a housing for holding a toner fed to the latent image formed on the image carrier, a developing roller provided to be rotatable about a rotation center positioned below a rotation shaft of the image carrier in a vertical direction, a supporting member as a part of the housing, for positioning the toner close to the developing roller, and an agitation member provided to be a rotatable in the housing and having sheet-like member having a free length which is defined to be longer than a distance between a rotation center of the sheet-like member and a wall surface of the housing, for feeding the toner in the housing to the supporting member and for agitating the toner in the housing, as the agitation member is rotated along an inner wall of the housing, wherein the supporting member is positioned lower in a vertical direction, compared with a rotation center of the agitation member.

8. An image forming apparatus comprising:

a photosensitive member on which a latent image corresponding to image information to be outputted is formed, a developing apparatus for supplying selectively a toner to the latent image formed on the photosensitive member, thereby to develop the latent image, said developing apparatus including a developing magnet internally provided with N and S poles arranged alternately, a sleeve formed to be rotatable on an outer circumference of the developing magnet, for supplying the toner to be supplied onto the latent image formed on the photosensitive member, a toner hopper as a part of a housing, provided below a rotation center of the sleeve in a vertical direction at a predetermined distance therefrom, and having a table for holding temporarily the toner which should be supplied to the sleeve, thereby to contain the toner, an agitation member formed to be rotatable in the toner hopper, as an elastic member having a longer free length than an inner diameter of the toner hopper, for feeding the toner in the toner hopper toward the sleeve and for agitating the toner, as the agitation member is rotated later in comparison with vicinity of a rotation center when the agitation member is rotated in the toner hopper, and a supporting member defined at a predetermined position in the housing, for temporarily supporting toner which is moved by the agitation member; and a transfer device for transferring a toner image formed on the photosensitive member by the developing apparatus, to a transfer target object.

9. An image forming apparatus according to claim 8, wherein the sleeve of the developing apparatus has an outer circumferential surface which is rotatable in the same direction as a direction in which a surface of the photosensitive member is rotated, at a position where the sleeve faces the photosensitive member, and the developing magnet is rotatable in a direction opposite to a direction in which the outer circumferential surface of the sleeve is rotated.

10. An image forming apparatus according to claim 8, wherein the toner used for the developing apparatus contains a magnetic toner.

11. An image forming apparatus according to claim 8, wherein the free length of the agitation member of the developing apparatus is longer by 0 to 3 mm than a distance between an inner wall of the housing and the rotation center of the agitation member.

12. An image forming apparatus according to claim 8, further comprising a scraper provided at a predetermined position above the supporting member of the developing apparatus and the sleeve in a vertical direction, for guiding the toner, which is fed by the agitation member, to the supporting member.

13. An image forming apparatus comprising an image forming section for forming a latent image on an image carrier, and a developing apparatus for supplying a visualizing agent to the latent image formed on the image carrier, thereby to develop the latent image, said developing apparatus including:

a housing for holding a toner fed to a latent image formed on an image carrier;

a developing roller provided to be rotatable about a rotation center;

a supporting member for temporarily supporting the toner in the housing; and an agitation member provided to be rotatable for feeding the toner in the housing to the supporting member and for agitating the toner in the housing, wherein a supporting member positioned lower in a vertical direction, compared with a rotation center of the agitation member.

* * * * *

UNITED STATES PATENT AND TRADEMARK OFFICE

CERTIFICATE OF CORRECTION

PATENT NO. : 6,308,037 B1
DATED : October 23, 2001
INVENTOR(S) : Toshimi Yamashita It is certified that error appears in the above-identified patent and that said Letters Patent is hereby corrected as shown below:

Title page,
Item [22], change the filing date from "Apr. 27, 2000" to -- Feb. 11, 2000 --

Signed and Sealed this

Thirtieth Day of July, 2002

*Attest:*

*Attesting Officer*

JAMES E. ROGAN
*Director of the United States Patent and Trademark Office*